US007101608B1

(12) United States Patent
Karnes

(10) Patent No.: US 7,101,608 B1
(45) Date of Patent: Sep. 5, 2006

(54) EAVE VENT INSULATION

(76) Inventor: James A Karnes, P.O. Box 942, Erie, PA (US) 16512

( * ) Notice: Subject to any disclaimer, the term of this patent is extended or adjusted under 35 U.S.C. 154(b) by 0 days.

(21) Appl. No.: 11/035,108

(22) Filed: Jan. 12, 2005

(51) Int. Cl.
*B32B 3/30* (2006.01)
*E04B 7/04* (2006.01)
*E04D 13/076* (2006.01)

(52) U.S. Cl. ..... 428/158; 428/156; 428/179; 428/182; 428/304.4; 52/95; 52/199

(58) Field of Classification Search ..... 428/304.4, 428/158, 156, 179, 182; 52/95, 199
See application file for complete search history.

(56) References Cited

U.S. PATENT DOCUMENTS 4,973,610 A * 11/1990 Hahn et al. ..... 521/89
5,079,790 A * 1/1992 Pouch ..... 5/630
2004/0134137 A1* 7/2004 Geer et al.

FOREIGN PATENT DOCUMENTS

GB 2244730 A * 12/1991

OTHER PUBLICATIONS

Translation of JP 2003-253834, Shimoda et al, "Eaves Board,", Sep. 10, 2003.*

* cited by examiner

*Primary Examiner*—Hai Vo
(74) *Attorney, Agent, or Firm*—Richard K. Thomson

(57) ABSTRACT

An insulative block of foam insulation has interspersed on an upper angled surface, a series of ridges and valleys. The valleys afford passageways for air circulation through the soffits and out the attic vents, be they ridge vents or attic turbines. This eave insulation prevents/reduces the thaw freeze phenomenon resulting from heat escaping in the vent region which results in the formation of ice dams which often produce roof damage.

6 Claims, 2 Drawing Sheets

EAVE VENT INSULATION

BACKGROUND AND SUMMARY OF THE INVENTION

The present invention is directed to the field of energy conservation. More particularly, the present invention is directed to an insulation unit which can provide significant R value while affording proper ventilation in the eaves of an attic.

Failure to properly insulate and ventilate attic eaves can create numerous problems for a home owner including, but not limited to, exorbitant fuel bills, formation of ice dams in gutters leading to roof and/or ceiling damage in the winter, retention of excessive heat in the attic increasing the costs of cooling the home beneath and baking any items stored in the attic space in the summer. In addition, without proper ventilation, moisture may accumulate in the attic leading to mold, mildew, and possibly, dry rot of the joists.

Most of these problems arise from improperly installed insulation which extends an improper distance into the eave area of the attic. It is difficult enough to achieve the proper balance of insulation and ventilation. When this difficulty is compounded by the lack of accurate information in the minds of most do-it-yourselfers who add R value to their existing attic insulation, you have a formula for failure.

The present invention provides a solution to these problems. The vent insulation of the present invention provides a simple, inexpensive insulation unit which may be inserted between the joists on 24" centers and pushed out into the eave area. No dimension of the vent insulation unit exceeds 2' and, accordingly, the vent insulation of the present invention augments, it does not replace, conventional insulation systems. The body of insulation is tapered from front to back at an angle which is in the range of between 20° and 60° and more preferably between 30° and 45° to mimic the pitch of the roof of the building in which the insulation is used.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 2:
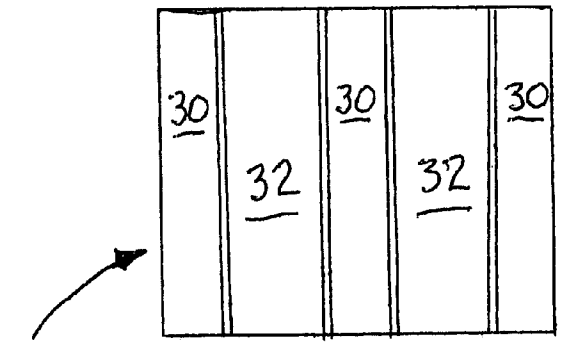
FIG. 2 is a top view of the first embodiment.
Figure 3:
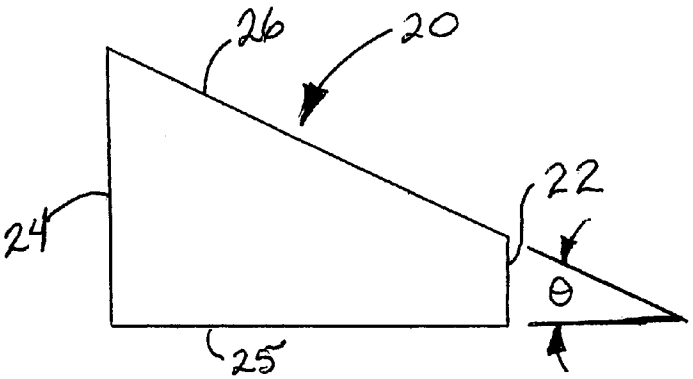
FIG. 3 is a side view of the first embodiment.
Figure 1:
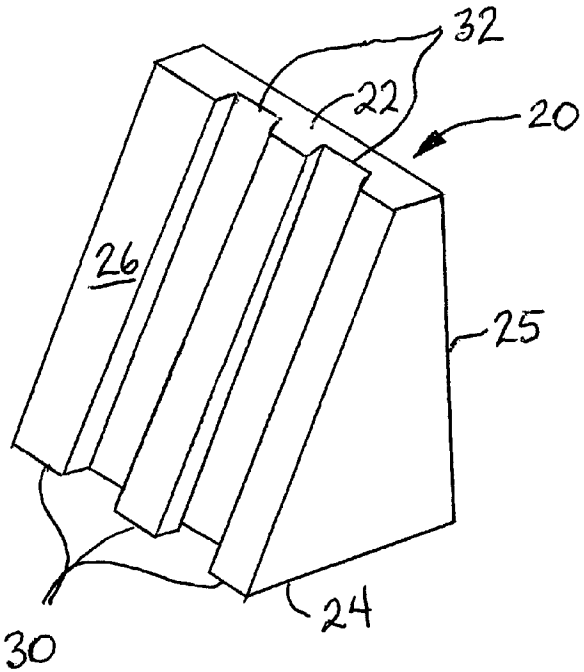
FIG. 1 is a top perspective view of a first embodiment of the cave vent insulation of the present invention.

A first embodiment of the attic eave ventilation of the present invention is depicted in FIGS. 1–5 generally at 20. Vent insulation 20 is a block which is generally trapezoidal in shape, tapering from a front face 22 to a rear face 24 at an angle θ which is generally consistent with the pitch of the roof of the building with which the insulation is used. Insulation block 20 has a flat bottom surface 25 and a sloping upper surface 26. Angle θ (FIG. 3) is in the range of between 20° and 60° and, more preferably, in the range of between 30° and 45°. Insulation block 20 is preferably made of an insulative foam such as an expandable polystyrene, light weight and easy to handle while providing significant insulating R value. One material which has proven useful in this application is STYROPOR, an expandable polystyrene with 6% by weight pentane as a blowing agent. The insulation block 20 has an R rating of 3.8 at 75° F., although it is believed actual resistance to thermal transmission will be significantly greater. Testing to demonstrate the level of the higher value is in progress.

Figure 5:
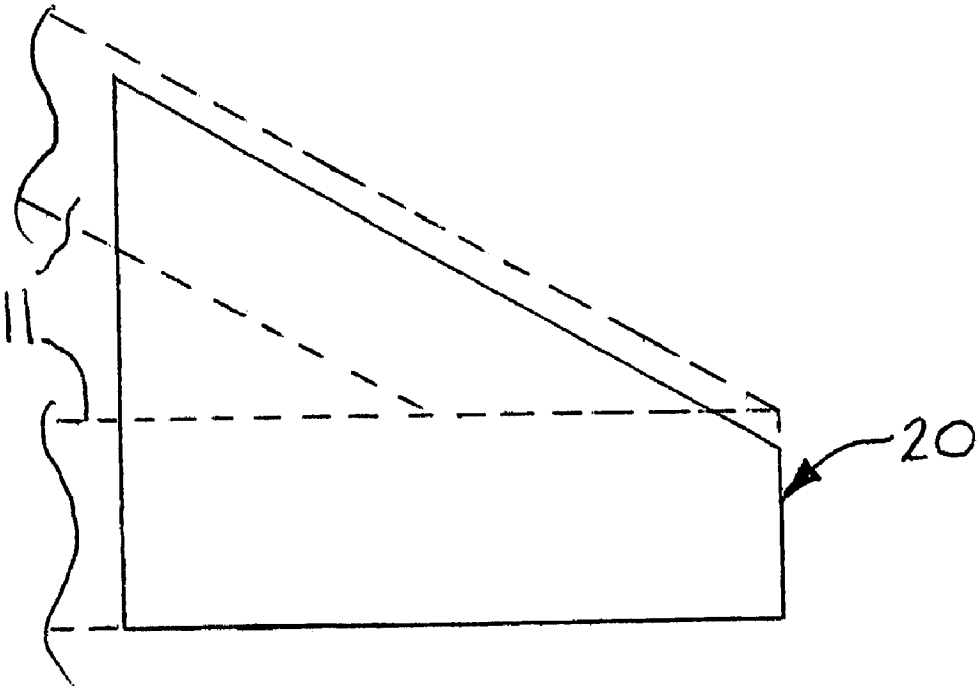
Figure 4:
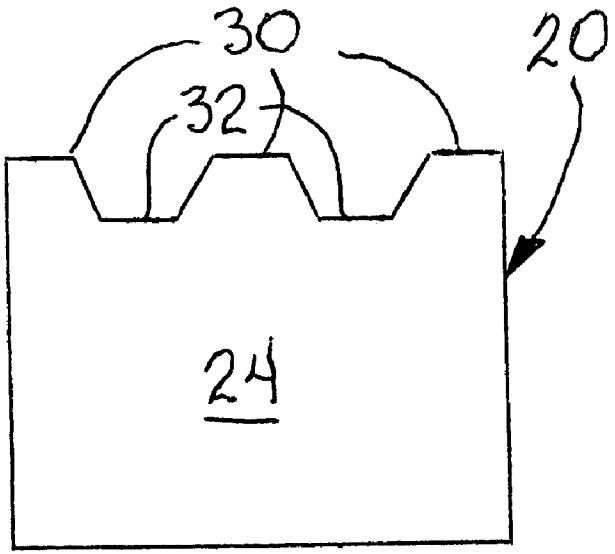
FIG. 4 is a back view of the cave vent insulation of the first embodiment and, FIG. 5 is a perspective schematic depicting the insulation of the present invention installed.

Upper surface 26 has a plurality of ridges 30 and valleys 32 interspersed therewith. The valleys 32 which are generally wider than ridges 30, afford airflow passages to permit air to circulate through the soffit perforations and carry heat out a ridge vent, attic turbine, or the like. As best seen in FIG. 5, insulation block 20 has no dimension which exceeds 2' so that it may be situated between adjoining joists 11 in an attic in the eave region. By way of example and not limitation, the block is 18" deep, front to back, 22⅜" wide and the maximum height will range from 8 to 18", depending on the angle θ, which, as noted above, is chosen to match the pitch of the roof. Ridges 30 are at least 1½" high and taper inwardly bottom to top.

This insulation block 20, marketed under the tradename INSULVENT, is intended to augment an existing ceiling insulation system, be it batt insulation, blown insulation, or some other variety. These blocks 20 make it simple to provide the right amount of insulation spaced the proper distance to reduce/eliminate heat escaping from the insulated airspace through the eaves melting snow in and around gutters which subsequently re-freezes producing ice dams and associated roof and ceiling damage. Air can circulate through the openings in the soffit, through valleys 32 in the upper surface 26 of block insulation 20 and out the attic vents, be they ridge vents or attic turbines.

Various changes, alternatives and modifications will become apparent to one of ordinary skill in the an following a reading of the foregoing specification. It is intended that any such changes, alternatives and modifications as fall within the scope of the appended claims be considered part of the present invention.

I claim:

1. An attic eave vent insulation for horizontal placement between ceiling joists in the attic beneath a roof panel which is supported by rafters, said attic eave vent insulation having a length extending between a first front face and a second rear face and a width extending between two lateral faces which fit between the joists and a height extending between a bottom surface and an upper surface, said vent insulation comprising:

a block of rigid foam insulation having no length, width or height dimension which exceeds 2', a series of ridges interspersed with valleys spaced across said width along said upper surface to afford passageways for air flow in a direction of said length along an undersurface of the roof between the rafters, said height of said block of insulation tapering from said first front face having a first maximum thickness to a second rear face having a second greater maximum thickness.

2. The vent insulation of claim 1 wherein said valleys have a second width significantly greater than a first width of said interspersed ridges.

3. The vent insulation of claim 1 wherein said rigid foam is expandible polystyrene with 6% by weight pentane.

4. The vent insulation of claim 1 wherein said tapering insulation forms a first angle which is generally equal to a second angle in a roof eave in which it is placed.

5. The vent insulation of claim 4 wherein said first angle lies in a range between 20° and 60°.

6. The vent insulation of claim 5 wherein said first angle is more preferably in the range of between 30° and 45°.

* * * * *